US009598810B2

(12) United States Patent
Im et al.

(10) Patent No.: US 9,598,810 B2
(45) Date of Patent: Mar. 21, 2017

(54) WASHING MACHINE AND METHOD FOR CONTROLLING WASHING MACHINE

(75) Inventors: Myonghun Im, Seoul (KR); Moonhee Hong, Seoul (KR); Kyungchul Woo, Seoul (KR); Sangheon Lee, Seoul (KR); Bosung Seo, Seoul (KR); Rayoung Park, Seoul (KR); Sooyoung Oh, Seoul (KR); Wooyoung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1317 days.

(21) Appl. No.: 13/045,904

(22) Filed: Mar. 11, 2011

(65) Prior Publication Data

US 2011/0219551 A1 Sep. 15, 2011

(30) Foreign Application Priority Data

Mar. 12, 2010 (KR) ..... 10-2010-0022460

(51) Int. Cl.
*D06F 39/00* (2006.01)
*D06F 25/00* (2006.01)
*D06F 58/28* (2006.01)

(52) U.S. Cl.
CPC ..... *D06F 39/003* (2013.01); *D06F 25/00* (2013.01); *D06F 58/28* (2013.01); *D06F 2058/2848* (2013.01)

(58) Field of Classification Search
None
See application file for complete search history.

(56) References Cited

U.S. PATENT DOCUMENTS 9,260,814 B2 * 2/2016 Seo ..... D06F 39/003

FOREIGN PATENT DOCUMENTS

| | | | | |
|---|---|---|---|---|
| FR | 2898912 | * | 1/2006 | ..... D06F 37/20 |
| JP | 2000-229193 A | * | 8/2000 | ..... D06F 33/02 |
| KR | 10-2006-0031065 | * | 10/2004 | ..... D06F 39/00 |
| KR | 10-2006-0031066 | * | 10/2004 | ..... D06F 39/00 |
| KR | 10-2006-0031065 | | 4/2006 | |
| KR | 10-2006-0031066 | | 4/2006 | |

OTHER PUBLICATIONS

English machine translations of 10-2006-0031066, 10-2006-0031065, and FR2898912.*

* cited by examiner

*Primary Examiner* — Joseph L Perrin
*Assistant Examiner* — Jason Riggleman
(74) *Attorney, Agent, or Firm* — Dentons US LLP

(57) ABSTRACT

A drum type washing machine includes: a tub installed in the interior of a main body and accommodating a rotary drum; a spring installed between an upper portion of the tub and the side of the main body; and a weight detection module installed between the tub and the main body, wherein the weight detection module includes a detection unit to detect the load of the tub; and a transmission unit to transmit data detected by the detection unit to a controller.

3 Claims, 6 Drawing Sheets

WASHING MACHINE AND METHOD FOR CONTROLLING WASHING MACHINE

FIELD OF THE DISCLOSURE

Embodiments of the present invention relate to a device for measuring the amount of clothes placed in a drum type washing machine and a method for controlling a washing machine using the same, and more particularly, to a device for measuring the amount of clothes, which is installed at a spring installed at an upper side of a tub of a drum type washing machine to connect the tub to a main body, and a method for controlling a washing machine by using the device.

BACKGROUND

In general, a washing machine is a device for washing laundry by repeatedly performing operations such as washing, rinsing, and the like. The washing machine includes a main body constituting an external appearance, a storage tub installed in the interior of the main body to store water, and a rotary tub rotatably installed in the interior of the storage tub. The laundry and washing water are put together with a detergent into the rotary tub, and the rotary tub is rotated to apply a physical impact to the laundry to wash the laundry. A washing machine in which a rotational axis of the rotary tub is horizontal is generally called a drum type washing machine.

As shown in FIG. 1, the drum type washing machine includes a main body 1 forming an external appearance, a tub 2 installed in the interior of the main body 1, a drum 3 rotatably installed at an inner side of the tub 2, accommodating the laundry and washing water, and rotating them, a motor 4 for rotating the drum, a spring 5 and a damper 6 for damping vibration and an impact transferred to the tub 2, and a door 7 for opening and closing the interior of the main body. A lift 3*a* mounted on an inner side of the drum 2 rotates the laundry loaded in the interior of the drum 3. Both upper ends of the tub 2 are connected by the spring 5, whereby the tub 2 is installed to be suspended (or caught) in the interior of the main body 1. The damper 6 is installed to hinge-connect the tub 2 and the main body 1 and damps vibration transferred from the tub 2 to the main body 1.

BRIEF SUMMARY

Meanwhile, the drum type washing machine senses the amount of the laundry loaded in the interior of the drum and appropriately controls a washing process. To this end, the drum type washing machine includes a sensor attached on the damper 6 in order to sense the amount of the laundry. However, in the washing machine, generally, the upper portion of the tub 2 and the upper portion of the main body 1 are connected by using the spring 5, and the laundry amount sensing scheme uses the damper. In these cases, when the type of the spring for connecting the tub to the main body at the upper side of the main body is changed, the washing machine must be changed to change the specification of the damper and the damper needs to be installed with the changed specification. This lack of compatibility causes user inconvenience and it is difficult to precisely sense the amount of the laundry in terms of the characteristics of the damper.

Therefore, in order to address the above problems, the various features described herein have been conceived.

One aspect is to provide a detection means installed at an upper side of a tub of a drum type washing machine to precisely detect the amount of the laundry introduced into a drum or the amount of washing water supplied to the interior of the tub.

Another aspect is to provide a method for modularizing the detection means so as to be used in various types and models of washing machines without being limited to certain production models.

According, there is disclosed a drum type washing machine including: a tub installed in the interior of a main body and accommodating a rotary drum; at least one spring installed between the tub and the main body; and a weight detection module installed between the tub and the main body, wherein the weight detection module includes a detection unit configured to detect the load of the tub; and a transmission unit configured to transmit data detected by the detection unit to a controller.

The weight detection module may be disposed between the spring and the main body, and one side of the weight detection module may be fastened to the spring and the other side of the weight detection module may be fastened to the main body.

The at least one spring may include a first spring fastened to the tub and a second spring fastened to the main body, and one side of the weight detection module may be fastened to the first spring and the other side of the weight detection module may be fastened to the second spring.

The controller may calculate the weight of clothes or water accommodated in the interior of the tub by using data transmitted from the weight detection module and control a washing process based on the calculation results.

The weight detection module may further include a sensor holder having a concave portion, on which the end of the spring is attached, formed at one side thereof and the detection unit is mounted on the other side thereof.

The weight detection module may further include a holder mounting member having a receiving part for accommodating the sensor holder mounted on an upper portion of the side of the main body.

The detection unit may be a strain gauge or the like whose displacement changes according to the load of the tub.

There is also disclosed a method for controlling the drum type washing machine using the weight detection module including: a step of measuring the load of the tub by using the weight detection module before the laundry is loaded into the tub; and a step of measuring the load of the tub after the laundry is loaded into the tub.

The method may further include a step of measuring the load of the tub by using the weight detection module before washing water is supplied to the interior of the tub and a step of measuring the load of the tub after washing water is supplied to the interior of the tub.

There is also disclosed a method for controlling a drum type washing machine having a dry function including measuring the load of the tub by using the weight detection module before a dry course starts; measuring the load of the tub periodically during the dry course operation; and determining the degree of dryness based on the load of the tub measured in the previous steps.

According to exemplary embodiments of the present invention, the device installed at an upper portion of the tub of the drum type washing machine precisely detects the amount of clothes and washing water placed or introduced into the drum. Also, because the detection means for detecting the load of the tub is modularized, the weight detection module can be applied to various types and models of washing machines without being limited to certain production models.

The foregoing and other objects, features, aspects and advantages may become more apparent from the following detailed description below when taken in conjunction with the accompanying drawings.

DETAILED DESCRIPTION

Hereinafter, the configurations and operations according to exemplary embodiments of the present invention will be described with reference to the accompanying drawings.

Figure 1:
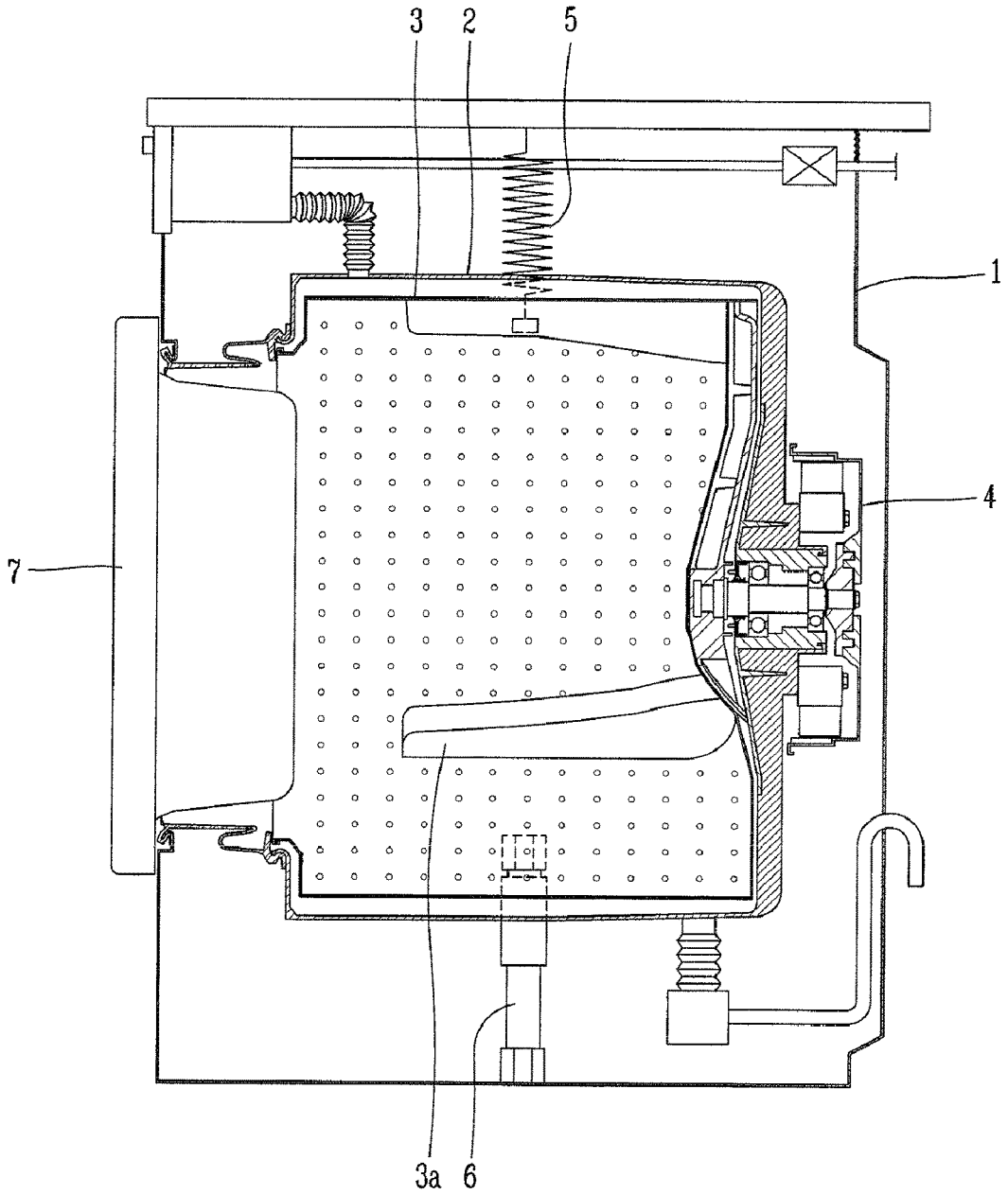
FIG. 1 (Prior Art)
FIG. 1 is a vertical sectional view of the related art washing machine.
Figure 2:
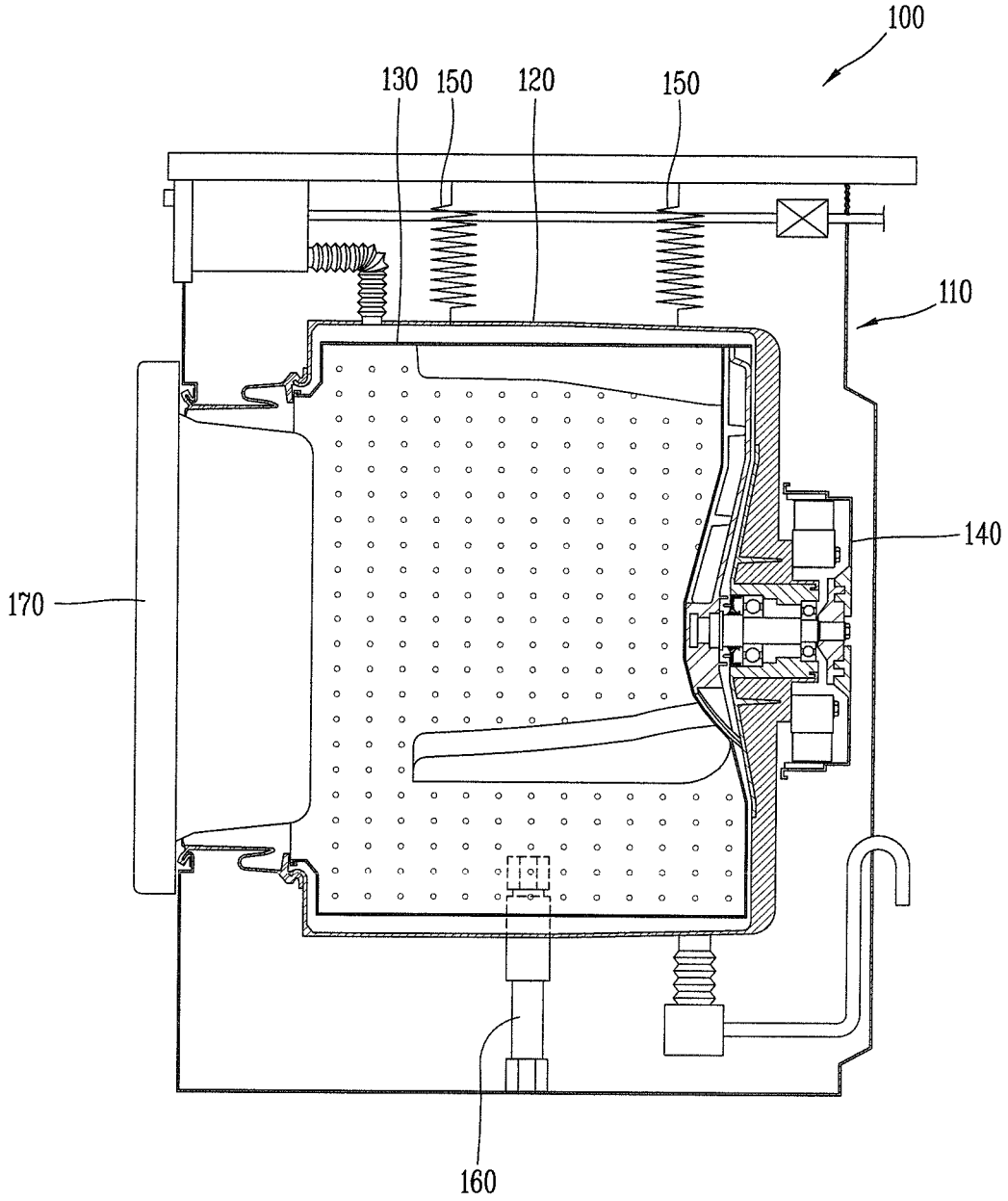
FIG. 2 is a vertical sectional view of a drum type washing machine according to an exemplary embodiment of the present invention.
Figure 3:
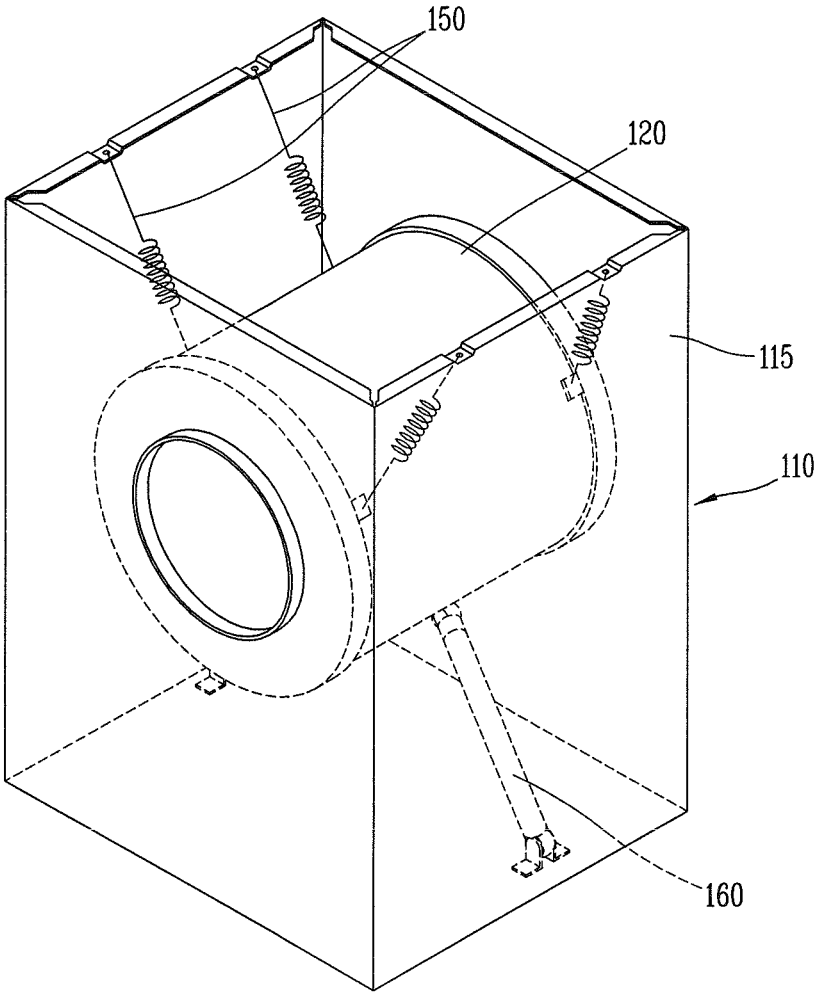
FIG. 3 is a perspective view showing only a portion of an internal configuration of the drum type washing machine of FIG. 2.

FIG. 2 is a vertical sectional view of a drum type washing machine according to an exemplary embodiment of the present invention, and FIG. 3 is a perspective view showing only a portion of an internal configuration of the drum type washing machine of FIG. 2.

With reference to FIGS. 2 and 3, a drum type washing machine according to an exemplary embodiment of the present invention includes a main body 110 forming an external appearance, a tub 120 installed in the interior of the main body 110, a drum 130 rotatably installed at an inner side of the tub 120 and accommodating and rotating the laundry and washing water, a motor 140 for rotating the drum 130, a spring 150 and a damper 160 for damping vibration and an impact transferred to the tub 120, and a door 170 for opening and closing the interior of the main body. Both sides of an upper portion of the tub 120 are connected by springs 150 so as to be attached to an upper side of a side surface 115 of the main body 110. The damper 160 hinge-connects a lower portion of the tub 120 with the main body to damp vibration transferred from the tub 120 to the main body 110. A plurality of springs may be provided to left and right portions of the main body. For example, as illustrated in FIG. 3, two springs may be provided on both the left and right portions of the main body.

The springs 150 are mounted to the side surface 115 of the main body, and a weight detection module according to an exemplary embodiment of the present invention is disposed between the springs 150 and the side surface 115 of the main body. In FIGS. 2 and 3, the weight detection module according to the present exemplary embodiment is not illustrated in terms of the explanation of the general configuration of the washing machine. The weight detection module serves to detect the load of the tub and transmit the detected load of the tub to the controller of the washing machine. The weight detection module will now be described hereinafter.

One end of the spring 150 is attached to one side of the upper end of the tub 120, and the other end of the spring is attached to an upper portion of the side surface 115 disposed at both sides of the main body 110. In some embodiments, a side frame may be provided to an upper portion of the side surface 115 in order to reinforce the strength of the side surface. In such embodiments, the other end of the spring may be attached to the side frame of the side surface of the main body. Hereinafter, the case in which the spring is attached to the upper portion of the side surface of the main body will now be described.

Figure 4:
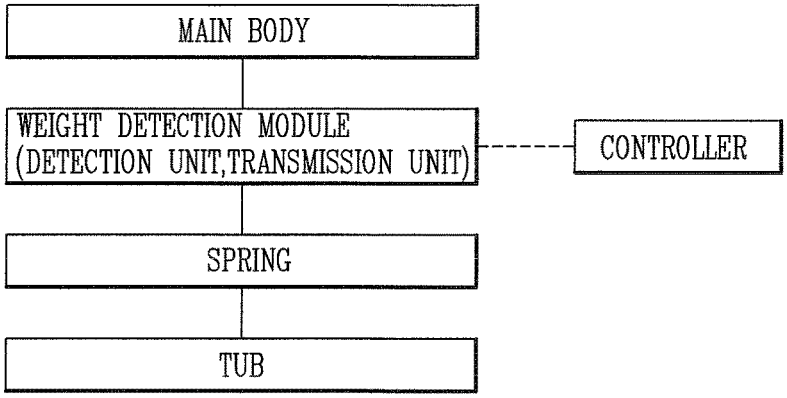
FIG. 4 is a schematic diagram of mounting a weight detection module according to an exemplary embodiment of the present invention.

FIG. 4 is a schematic diagram of mounting a weight detection module according to an exemplary embodiment of the present invention. As shown in FIG. 4, the weight detection module is disposed between the tub 120 and the main body to detect the load of the tub 120. In other words, one side of the weight detection module is connected to the main body, and the other side of the weight detection module is connected to the tub. Further, a spring is provided between the tub and the weight detection module to damp vibration of the tub generated according to the rotation of the drum. The weight detection module detects the load of the tub transferred through the spring and transmits the same to the controller. To this end, the weight detection module includes a detection unit for detecting the load of the tub and a transmission unit for transmitting the data detected by the detection unit to the controller.

The controller of the drum type washing machine performs washing, rinsing, spin-drying and drying processes according to a washing course selected by the user. The conditions such as the amount of water or a detergent to be applied or introduced in performing the course selected, a duration in which the selected course is performed, and the like, must be determined based on the amount of the laundry, namely, the amount of clothes, placed in the interior of the washing machine so as to be washed. To this end, the controller determines the weight of the clothes accommodated in the interior of the tub by using the data transmitted from the weight detection module and then performs the course which has been selected under conditions fitting the corresponding amount of clothes.

Figure 5:
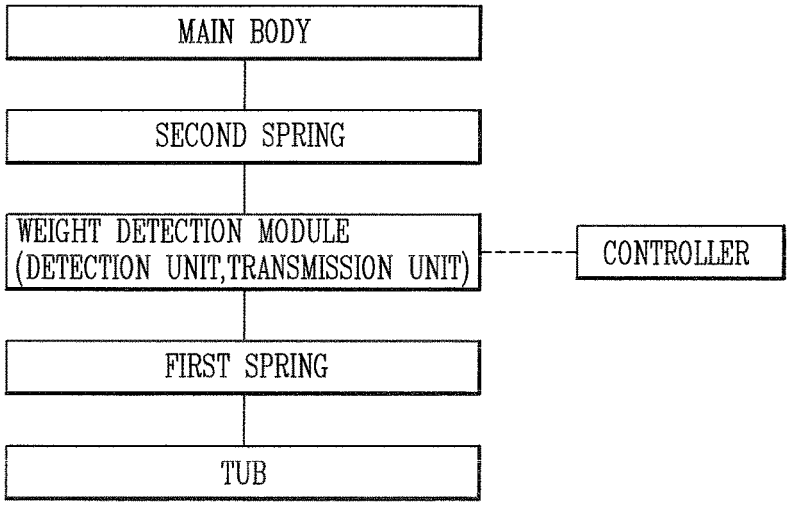
FIG. 5 is a schematic diagram of mounting a weight detection module according to another exemplary embodiment of the present invention.

FIG. 5 is a schematic diagram of mounting a weight detection module according to another exemplary embodiment of the present invention. As shown in FIG. 5, the weight detection module is disposed between the tub 120 and the main body to detect the load of the tub 120. One side of the weight detection module is connected to the main body, and the other side of the weight detection module is connected to the tub, like the weight detection module illustrated in FIG. 4. However, compared with the weight detection module illustrated in FIG. 4, in the present exemplary embodiment, a first spring is provided between the tub and the weight detection module to damp the vibration of the tub generated according to the rotation of the drum, and a second spring is provided between the weight detection module and the main body to additionally damp vibration. Also, like the weight detection module according to the exemplary embodiment of FIG. 4, the weight detection module according to the present embodiment detects the load of the tub delivered through the spring and transmits the same to the controller. To do this, the weight detection module includes a detection unit for detecting the load of the tub and a transmission unit for transmitting the data detected by the detection unit to the controller.

In this manner, since the weight detection module configured by modularizing the device for detecting the load of the tub is provided, although some of the constituents such as the tub of the washing machine, the spring mounted on the tub, or the like, are changed, the modularized weight detection module can be applied as it is. Thus, a problem of the related art in which when the configuration, such as the spring, or the like, of the load detection device installed on the damper under the tub according to the related art is changed, the specification of the load detection device installed on the damper must be changed to be applied can be solved. In other words, in the present exemplary embodiment, since the detection means for detecting the load of the tub is modularized, it can be used in various types or models of washing machines without being limited to certain production models. Thus, even when the maker model of a washing machine is changed, the weight detection module according to the present exemplary embodiment can be installed to be used as it is, providing excellent compatibility. In addition, the configuration of the weight detection module facilitates the weight detection module to be easily mounted between the main body and the tub and also to be easily removable.

Figure 6:
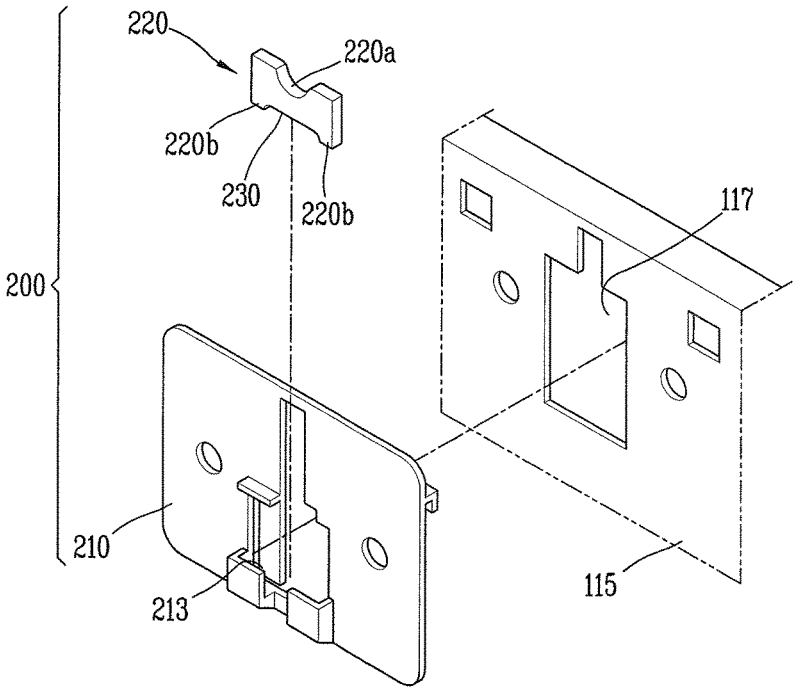
FIG. 6 is an exploded perspective view of the weight detection module according to an exemplary embodiment of the present invention.
Figure 7:
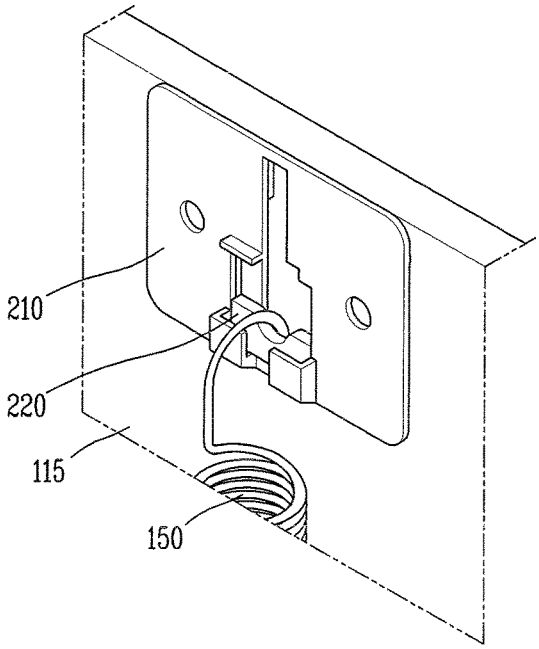
FIG. 7 is a view illustrating a configuration in which one end of a spring is attached in the weight detection module of FIG. 6.

FIG. 6 is an exploded perspective view of a weight detection module 200 according to an exemplary embodiment of the present invention and FIG. 7 is a view illustrating a configuration in which one end of a spring is attached to the weight detection module 200.

The weight detection module 200 is provided to be connected to the spring 150 at an upper portion of the side surface 115 of the main body 110. The weight detection module 200 may measure the force applied by the tub to the spring to detect the amount of clothes placed in the tub. To this end, a mounting hole 117 is formed on the side surface 115 of the main body of the washing machine to allow the weight detection module 200 to be mounted therein.

The weight detection module 200 according to the present exemplary embodiment includes a holder mounting member 210 directly attached to the side surface 115 of the main body of the washing machine, a sensor holder 220 mounted on the holder mounting member 210, and a sensor 230 configuring a detection unit attached to the sensor holder and detecting the load of the tub. The holder mounting member 210 is mounted on the side surface 115 by using a fastening tool, such as a volt, or the like, and includes a receiving part 213 for accommodating the sensor holder 220. The sensor holder 220 has a concave portion 220*a* formed at central portion of an upper surface thereof, allowing the end of the spring 150 to be attached therein. Protrusions 220*b* protruded downward are formed at both sides of a lower surface of the sensor holder 220. When the sensor holder 220 is mounted on the holder mounting member 210, the protrusions 220*b* of the sensor holder 220 are in contact with the bottom of the receiving part 213 of the holder mounting member 210, supporting the load (or weight). The sensor 230 constituting the detection unit is attached to an area between the protrusions 220*b* at both sides of the lower surface of the sensor holder 220. The sensor 230 may be a strain gauge or the like.

In the drum type washing machine according to the present exemplary embodiment, the weight detection module 200 is mounted on the side surface 115, and the end of the spring 150 is received in the concave portion 203*a* of the sensor holder 230. Thus, the concave portion 230*a* of the sensor holder 230 is weighted downward by the spring, and in this case, since the protrusions 220*b* of the lower surface of the sensor holder 220 are in contact with the receiving part 213 of the holder mounting member 210, the central portion of the lower surface of the sensor holder 230 on which the sensor is attached is bent to be convex resulting in an increase in its length. Then, the length of the sensor 230, namely, the strain gauge, attached to the central portion of the lower surface is accordingly increased, so the load (or weight) can be measured by using the extended length of the strain gauge.

That is, the amount of change in the strain gauge is measured by using the relationship between the force (or load) applied by the spring to the concave portion of the sensor holder and the length of the strain gauge and by using the fact that the load of the spring is proportional to the load of the tub, thus detecting the load of the tub. In this manner, the detection unit of the weight detection module 200 detects the load of the tub, the transmission unit of the weight detection module 200 transfers the corresponding data through an electrical signal to the controller of the washing machine, and the controller appropriately controls the operation of the washing machine based on the received electrical signal.

In the above description, the sensor holder 220 is accommodated in the holder mounting member 210 and the holder mounting member is mounted on the side surface 115 of the main body of the washing machine. However, the holder mounting member 210 may be omitted and the sensor holder 220 may be directly mounted on the side surface 115 of the main body.

Figure 8:
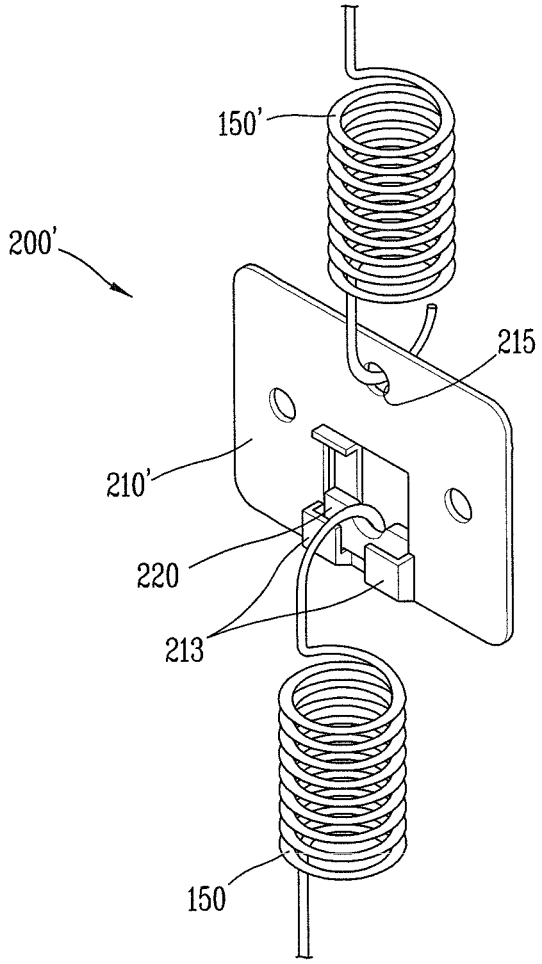
FIG. 8 is a view illustrating the weight detection module according to another exemplary embodiment of the present invention.

FIG. 8 is a view illustrating the weight detection module according to another exemplary embodiment of the present invention.

A weight detection module 200' according to the present exemplary embodiment includes a holder mounting member 210', the sensor holder 220 mounted on the holder mounting member 210', and a sensor 230 constituting a detector attached to the sensor holder 220 and detecting the load of the tub. In the present embodiment, the weight detection module 200' is positioned between the first spring 150 and the second spring 150'. The first spring 150 is mounted on the tub and the second spring 150' is mounted on the side surface 115 of the main body. Namely, the holder mounting member 210' is not directly mounted on the side surface 115 of the main body but indirectly mounted on the side surface 115 by the medium of the second spring 150'. To this end, the holder mounting member 210' includes a fastening hole 215 in which the second spring 150' is fastened.

The holder mounting member 210' includes a receiving part 213 for accommodating the sensor holder 220. The configuration in which the sensor holder 220 has a concave portion formed at a central portion of an upper surface thereof to allow an end of the first spring 150 to be received therein, both sides of the lower surface of the sensor holder 220 have protrusions which are downwardly protruded, and a sensor constituting the detection unit is attached to a central portion between the protrusions is the same as that of the former exemplary embodiment, so a detailed description thereof will be omitted.

The operation process of the washing machine using the weight detection module according to an exemplary embodiment of the present invention will now be described.

First, the tub 120 in the interior of the main body 110 of the washing machine is mounted in the main body 110 by the plurality of dampers mounted at the lower side and the springs 150. Here, the end of the spring 150 is mounted to be caught on the concave portion 220*a* of the sensor holder 220 of the weight detection module 200. In this case, since the strain gauge is deformed according to the size of the weight applied to the concave portion 220*a* by the end of the spring, the load applied by the spring to the weight detection module can be measured. An initial weight applied to the tub, the motor, or the like, in the washing machine is initialized by the controller, and it is not added to the weight of clothes loaded afterwards.

When clothes are placed into the drum 130 of the drum type washing machine and the user operates the washing machine, the controller detects the weight of clothes loaded in the drum 130 based on the signal detected according to the deformation of the strain gauge attached to the lower surface of the sensor holder and performs a washing course, a spin-drying course, a rinsing course, and the like, selected to fit the weight. Here, a clothes amount signal transferred to the controller may be measured before the washing machine starts to operate, namely, before washing water is supplied. In this manner, at a point in time when the washing course is selected and the washing machine starts to operate, the controller of the washing machine detects the amount of clothes which has been placed into the drum and then appropriately controls the washing process such as the amount of washing water, a washing time, or the like, in consideration of the detected weight.

Also, the controller can determine whether or not the amount of water required for the selected washing course has been supplied. As described above, the controller of the washing machine detects the amount of clothes, calculates the amount of washing water to be supplied during the washing process, and opens a water supply valve to supply water to the interior of the tub. In this case, when water is supplied to the interior of the tub, the load of the tub is increased and spring 150 applies force, tantamount to the increased load of the tub, to the weight detection module. Then, the controller of the washing machine continuously measures the weight of the tub before water is supplied to the interior of the tub and the weight of the tub which is increased while water is being applied thereto by using the weight detection module, to thus determine whether or not the required amount of water has been supplied to the interior of the tub of the washing machine and controls the operation of the washing machine based on the determinations.

Also, vibration of the washing machine can be detected by using the weight detection module. The tub makes a rotational movement in the washing, rinsing and spin-drying process, and in this case, when clothes in the interior of the drum are unevenly distributed, the tub may vibrate. The vibration caused by the uneven distribution of the clothes is especially problematic in the spin-drying process in which the drum rotates at a high speed. When the drum vibrates, an irregular force (or load) is applied to the spring 150, and accordingly, an irregular load is applied to the weight detection module 200. When the weight detection module 200 detects such an irregular load, the controller can determine that the drum is vibrating.

Also, when the washing machine has a dry function as well as the washing function, the degree of dryness can be measured by using the weight detection module 200. Namely, when the washing machine has the dry function, after the selected washing course is completed with the completion of the washing, rinsing, and spin-drying process the user may select the dry process. When the dry process is selected, the controller of the washing machine measures the weight of the clothes immediately before the dry process starts, namely, the weight of the clothes which contains a certain amount of moisture in a state in which the washing course is completed, by using the weight detection module 200. As the dry process is proceeding, heated air is supplied to the drum of the washing machine, removing moisture from the clothes in the interior of the drum, so the moisture contained in the clothes in the drum is gradually evaporated to be reduced. Since the weight of the clothes is measured by using the weight detection module, the amount of moisture released from the clothes can be detected, and as a result, the degree of dryness of the clothes in the interior of the drum can be determined.

As the present invention may be embodied in several forms without departing from the characteristics thereof, it should also be understood that the above-described embodiments are not limited by any of the details of the foregoing description, but rather should be construed broadly. Therefore all changes and modifications that fall within the metes and bounds of the claims, or equivalents of such metes and bounds are therefore intended to be embraced by the appended claims.

What is claimed is:

1. A method for controlling a drum type washing machine comprising a tub installed in the interior of a main body and accommodating a rotary drum; at least one spring installed between the tub and the main body; and a weight detection module installed between the tub and the main body, wherein the weight detection module comprises a holder mounting member directly attached to a side surface of the main body, a sensor holder mounted on the holder mounting member, a sensor configured to be a detection unit attached to the sensor holder to detect a load of the tub, wherein the holder mounting member includes a receiving part to accommodate the sensor holder, wherein an end of the spring is attached at a central portion of an upper surface of the sensor holder, the method comprising the steps of:

measuring the weight of the tub by using the weight detection module before the laundry is loaded into the tub; and measuring the weight of the tub after the laundry is loaded into the tub.

2. The method of claim 1, further comprising the steps of:

measuring the weight of the tub by using the weight detection module before washing water is supplied to the interior of the tub; and measuring the weight of the tub after washing water is supplied to the interior of the tub.

3. A method for controlling a drum type washing machine described in claim 1, the method comprising the steps of:

measuring the weight of the tub by using the weight detection module before a dry course starts;

measuring the weight of the tub periodically during the dry process operation; and determining the degree of dryness based on the measured weight of the tub.

* * * * *